US005488794A

United States Patent [19]

Arrequin

[11] Patent Number: 5,488,794

[45] Date of Patent: Feb. 6, 1996

[54] TAMPER PROOF GUN LOCK

[76] Inventor: Phillip M. Arrequin, 8572 Davmor Ave., Garden Grove, Calif. 92641-1505

[21] Appl. No.: 391,261

[22] Filed: Feb. 21, 1995

Related U.S. Application Data

[63] Continuation of Ser. No. 229,350, Apr. 18, 1994, abandoned.

[51] Int. Cl.[6] ..... F41A 17/44

[52] U.S. Cl. ..... 42/70.11; 42/66

[58] Field of Search ..... 42/70.11, 70.01, 42/66, 67

[56] References Cited

U.S. PATENT DOCUMENTS

| | | | |
|---|---|---|---|
| 2,803,909 | 8/1957 | Soski et al. | 42/66 |
| 2,836,918 | 6/1958 | Pula et al. | 42/70.11 |
| 4,224,753 | 9/1980 | Bielman | 42/70.11 |
| 4,461,108 | 7/1984 | Von Muller | 42/70.11 |
| 4,479,320 | 10/1984 | Fix | 42/70.11 |
| 4,783,924 | 11/1988 | Thurber | 42/70.11 |
| 4,802,299 | 2/1989 | Baugus | 42/66 |

FOREIGN PATENT DOCUMENTS

| | | | |
|---|---|---|---|
| 8600396 | 1/1986 | WIPO | 42/70.11 |

*Primary Examiner*—Stephen M. Johnson
*Attorney, Agent, or Firm*—Michael I. Kroll

[57] ABSTRACT

A tamper proof gun lock is provided, which consists of a double dummy cartridge adapted to be received in a firing chamber of a gun. A keeper is adapted to be inserted into a bore of a barrel of the gun. A tool is insertable into the barrel of the gun, to engage with the keeper. In a first instance, the tool can cause the keeper to connect to one portion of the double dummy cartridge, making the gun inoperable by preventing the gun from being fired. In a second instance, the tool can cause the keeper to disconnected from the one portion of the double dummy cartridge, thus allowing the keeper to be removed from the barrel and the double dummy cartridge to be removed from the firing chamber of the gun, making the gun operable to be fired.

14 Claims, 4 Drawing Sheets

Fig. 1
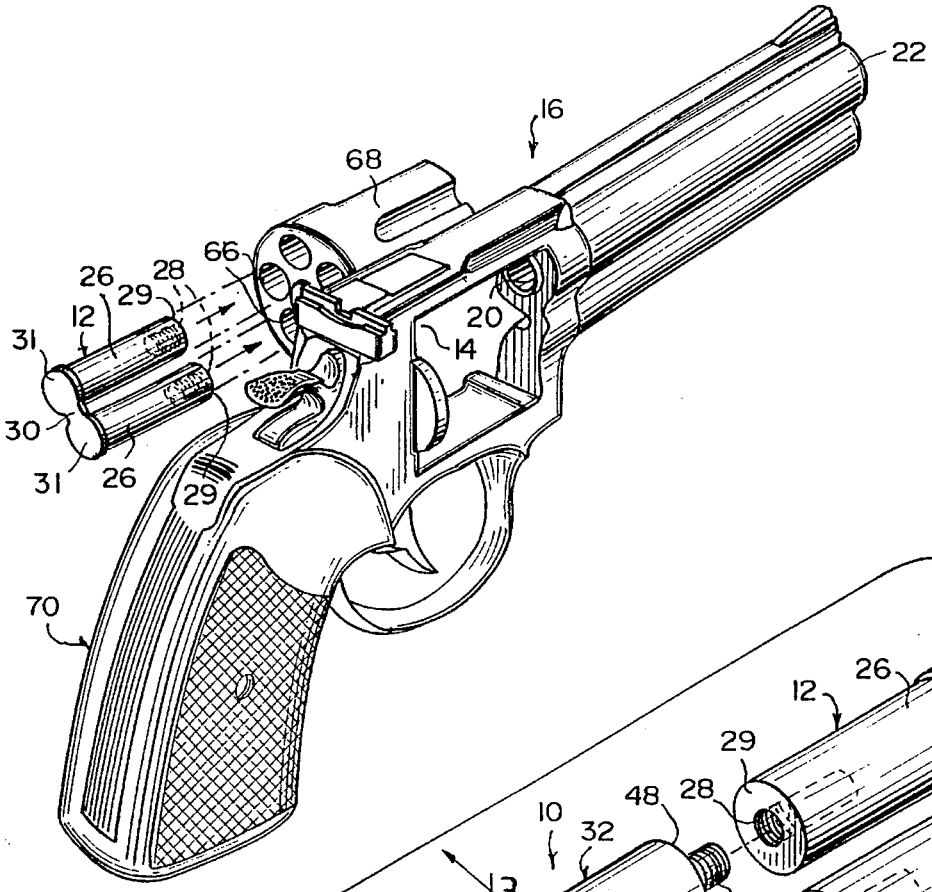
Fig. 2
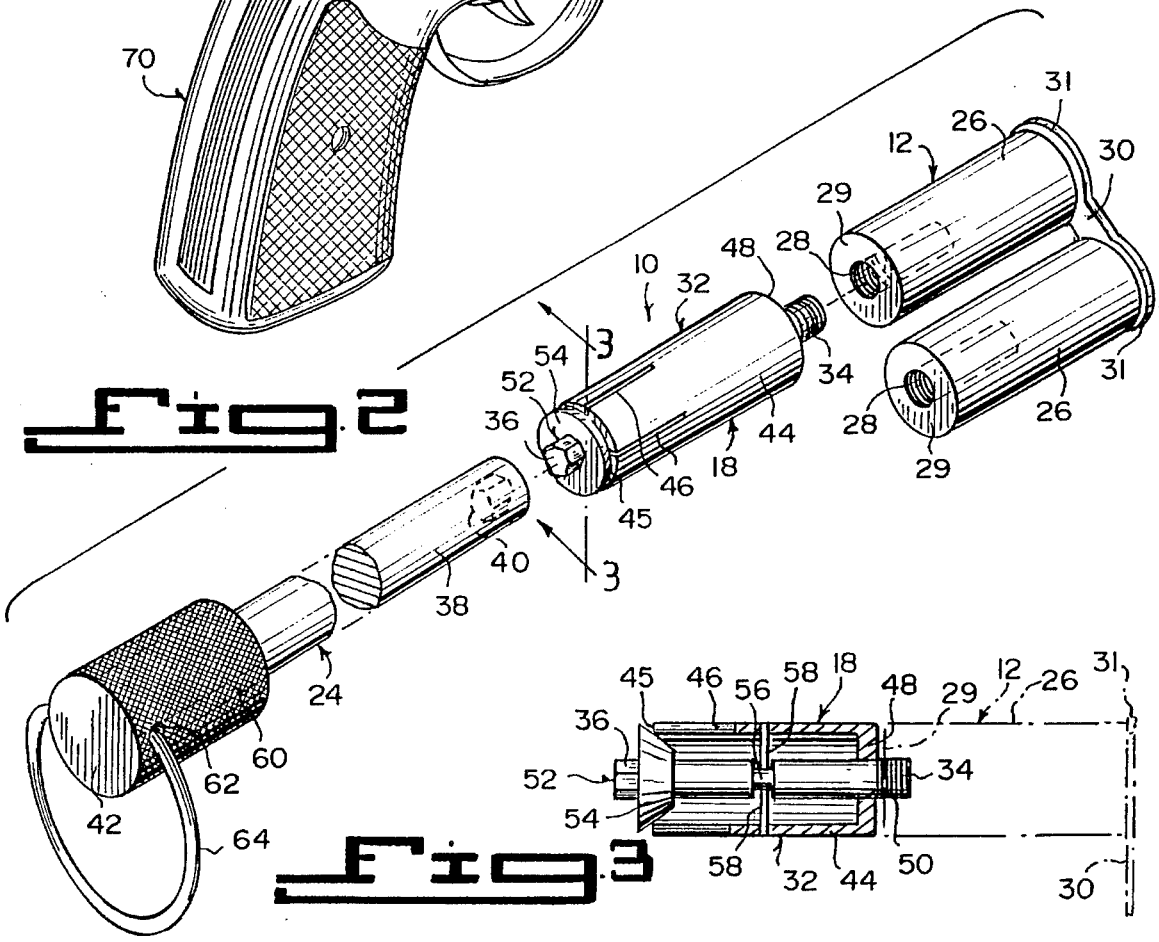
Fig. 3

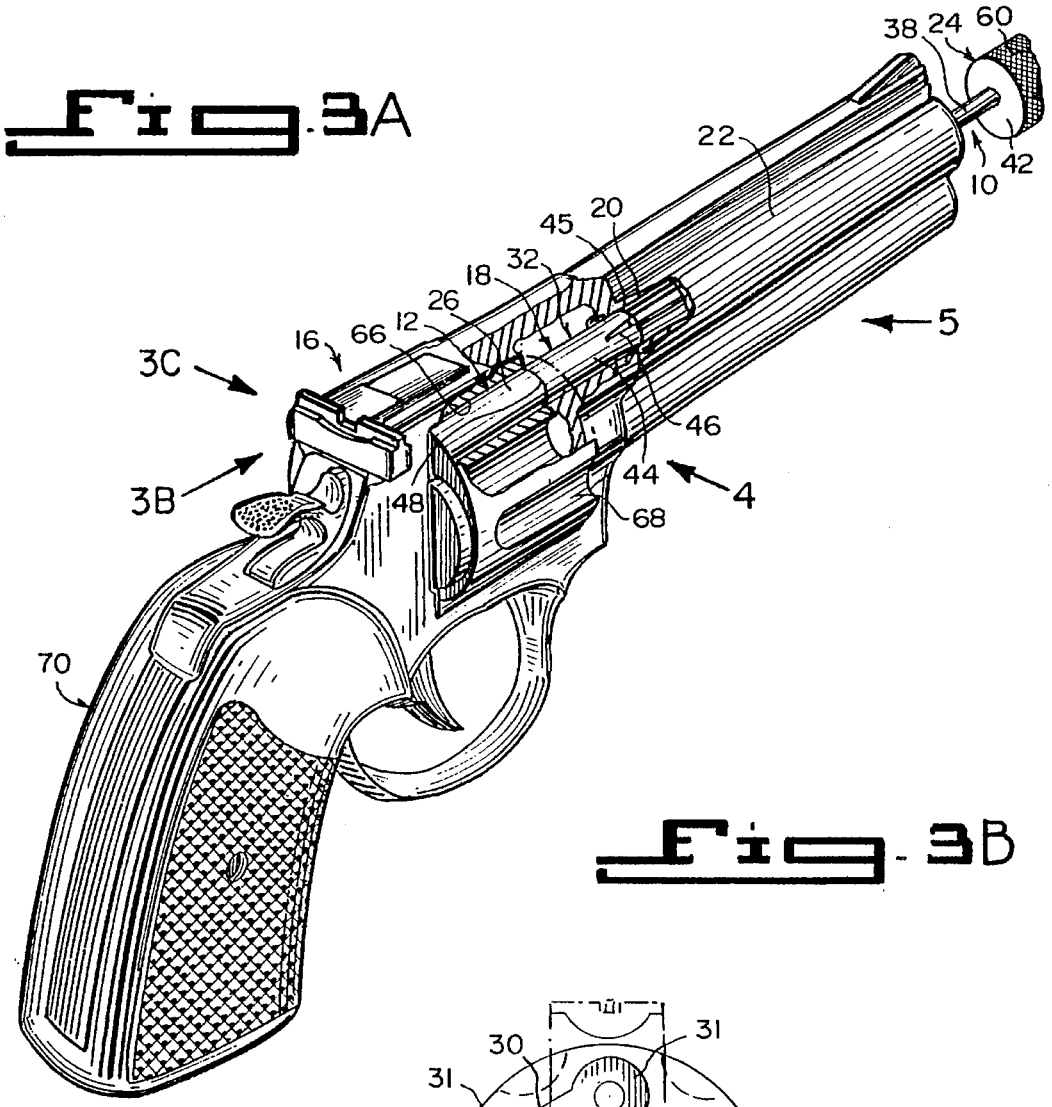
Fig. 3A
Fig. 3B
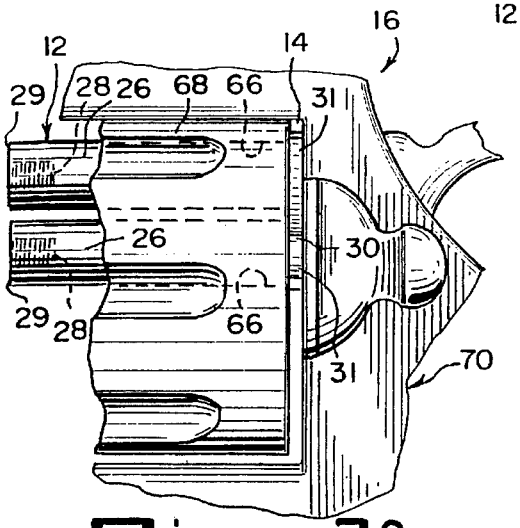
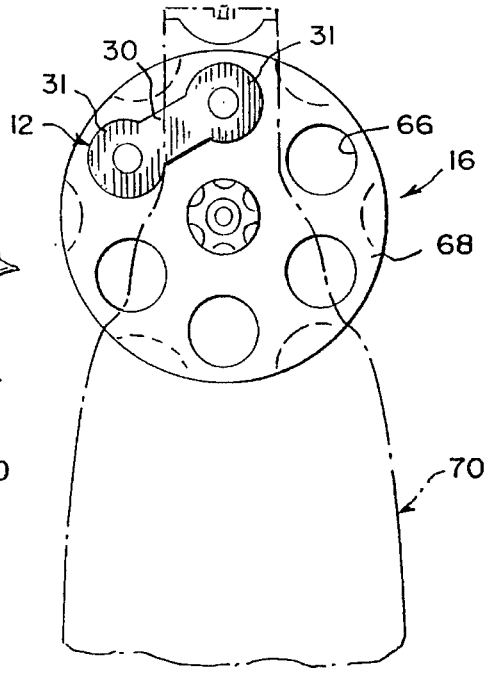
Fig. 3C

TAMPER PROOF GUN LOCK

This application is a continuation of application Ser. No. 08/229,350, filed Apr. 18, 1994, now abandoned.

BACKGROUND OF THE INVENTION

1. Field of the Invention

The instant invention relates generally to firearm safety devices and more specifically it relates to a tamper proof gun lock.

People, many of them children are shot by handling loaded guns. Accidental shootings occur through carlessness and unauthorized use of handguns. A child may find a handgun on top of a closet or in a dresser drawer and shoot another child. Adults routinely shoot themselves and others accidentally while handling or cleaning supposedly unloaded guns.

2. Description of the Prior Art

Numerous firearm safety devices have been provided in prior art. For example U.S. Pat. Nos. 2,478,098 to Hansen; 2,836,918 to Paula et al.; 2,887,807 to Santangelo; 3,022,598 to Wikstrom; 3,027,674 to Mahan; 3,360,880 to Finnegan; 3,368,297 to Lentz; 4,023,294 to Knopp; 4,038,771 to Miller; 4,092,794 to Moren; 4,224,753 to Bielman; 4,398,366 to Wernicki; 4,479,320 to Fix; 4,827,649 to Sheehan; 4,908,971 to Chaney; 5,001,854 to Derman; 5,048,211 to Hepp and 5,052,142 to Mikus all are illustrative of such prior art. While these units may be suitable for the particular purpose to which they address, they would not be as suitable for the purposes of the present invention as heretofore described.

A safety device for guns comprising a rod approximately equalling the length of a gun barrel is adapted for insertion therein, having a key socket in its muzzle end and a split bushing of approximately the diameter of a gun barrel. The split bushing is in tapered thread connection with the socket end of the rod. A key is adapted to be inserted through the bushing into the rod socket. When the device is inserted in the barrel relative rotation between the rod and bushing is effected to expand the bushing for frictional engagement with the bore of the barrel.

A firearm safety device comprising: an internally threaded, expansible sleeve insertable in the breech of a gun barrel. A smooth counterbored end portion provides a shoulder and has a circumferential groove therein. A plug is threadedly mounted in the sleeve for expanding same and has a kerf in an end thereof for the reception of an actuating tool. A snap ring is mounted in the groove. A guard for the plug comprising a disk is freely rotatable in the counterbore between the shoulder and the snap ring and is spaced from the plug. The disk has a slot therein to be brought into parallelism with the kerf for the insertion of the tool therein.

A firearm locking device comprising a housing having a longitudinally extending cylindrical bore in one end portion thereof, adapted to fit over the end of a firearm barrel. The end portion has a longitudinally extending slot formed in the wall thereof, adapted to accommodate the barrel sight therein. The bore and the slot being of a length to have the end of the barrel disposed short of the inner end of the bore when the sight abuts the inner end of the slot to leave an empty space within the bore. Apertures formed in the walls of the housing open into the space. An elongated tube is fixed by one end within the bore in centrally spaced relation to the sides of the bore. The tube has a longitudinally grooved outer surface. A second longitudinally extending bore is formed in the other end portion of the housing and communicates with the first bore. A cylinder lock is fitted within the second bore. The cylinder lock includes a key-actuated core communicating with the interior of the tube with its center point disposed in eccentric relation to the center of the tube. A rod is secured by one end to the center of the cylinder lock core and extends through the tube. A cam disk is secured to the end of the rod, exteriorly of the tube and is arrange to register with the end of the tube in one position thereof and to overhang the tube in another position thereof.

A safety device for a revolver having a barrel and a rotatable cylinder provided with chambers to carry rounds of ammunition into alignment with the barrel of the revolver. The safety device comprising: a dummy round. The dummy round consisting of a cartridge case, a bullet portion movably mounted within the cartridge case and spring biasing the bullet portion into said cartridge case. The dummy round has the outline dimensions of a live round when the bullet portion is in the biased position. A means insertable through the barrel of the revolver engages the bullet portion and extends the bullet portion into the barrel of the revolver. A means is to hold the last-named means in the extended position.

In combination with a gun having a barrel and a member provided with at least one cartridge-holding chamber. The member is movable transversely of the axis of the barrel from a closed position wherein the chamber is in registry with the barrel to an open position out of registry therewith for loading and unloading. A safety locking device for the gun is adapted to be installed in the chamber for preventing movement of the member from the closed to the open position. The device comprising a casing fitting the chamber and a plunger. A spring is mounted in the casing. The plunger is retractable against the spring from an extended to a retracted position. The overall length of the device with the plunger extended is greater than that of the chamber. The plunger when so extended will protrude into the barrel and lock the member in registry therewith. The overall length of the device with the plunger retracted is no greater than that of the chamber. The member can be moved between its open and closed position. The device includes a means preventing the plunger and casing from coming apart.

This disclosure relates to a casing and plunger structure in the shape of a cartridge insertable with the chamber of a revolver. When the particular opening in the chamber is aligned with the revolver barrel, the plunger will extend from the cartridge-like casing into the barrel and thus lock the gun. The gun can only be unlocked for use by inserting an instrument through the barrel of the revolver to key into the plunger and return it within the casing such as to be out of interference with the gun barrel.

According to the present invention a safety rod is provided lockable in relation to a gun, rendering such gun inoperative and assuring that there is no bullet in the gun aligned with the barrel and/or firing chamber. The rod inserted within the chamber is anchored and locked at the trigger guard of the weapon.

For insertion in a firearm to prevent discharge thereof, a plastic rod having longitudinal ribs fits in the barrel and extends into one of the cylinder chambers of the weapon. The outer end of the rod is recessed from the muzzle end of the barrel and is tapped and threaded. A key threads into the rod and may be pulled outwardly to remove the rod from the gun barrel.

A load safety device for a revolver having a cylinder movable laterally from the gun receiver to a position in which its rearward face is unobstructed for insertion of cartridges into the chambers thereof. An ejector is operable to move the cartridges rearwardly from the chambers. The safety device consists of a hollow receptacle positionable over the rearward end of the cylinder to receive the cartridges as they are partially ejected from the cylinder. The receptacle has a spring-loaded pressure plate biasing the cartridges toward full engagement in the cylinder. A connector is for releasably joining the receptacle to the ejector operating rod to secure the cartridges in a partially ejected position.

The safety device of the present invention comprises a longitudinally extensible element adapted to be placed in one chamber of a revolver type gun. The cylinder can be closed and the device positioned to extend through the chamber into the bore of the barrel to prevent the cylinder from rotating thus preventing the gun from being operated. The device is designed so that it must be rotated within the gun barrel to remove it from the gun so that individuals not knowing how the device operates cannot easily remove the device from the gun.

A safety device for firearms includes a dummy cartridge adapted to be seated in the chamber of the barrel. An elongated rod is threaded into the nose of the bullet end of the dummy cartridge. A muzzle cap is attached to the other end of the rod and is seated in and closes the muzzle. The muzzle cap is adapted to be engaged by a hand tool thereby to unthread the rod from the dummy cartridge to permit removal of the rod and muzzle cap from the muzzle of the firearm and the dummy cartridge from the chamber. A porous sleeve impregnated with a material which emits a rust inhibiting vapor may be placed on the rod between the dummy cartridge and the muzzle cap.

A gun lock consisting of three parts which engage each other to provide a shaft extending through the gun barrel and the bullet chamber. The shaft is held in position by means of a combination lock. A dummy round occupies the bullet chamber and has a hollow cylindrical front portion with a groove for engaging the locking balls which are disposed on the inner end of an intermediate rod which extends through the bore of the gun barrel. The intermediate rod has a slideably movable central actuator with a cam end portion for forcing the locking balls radially outward to engage the groove of the dummy round, and semi-circular recesses into which the locking balls can fall when the actuator is pushed in to permit insertion or removal of the intermediate rod. The combination lock secures the actuator to prevent it from being moved inward to release the intermediate member from the dummy round.

This invention relates to an improved lock for revolver cylinders of the type that releasably locks the latter against rotation by passing a rod from the barrel into one of its chambers. The improvement is characterized by a loose-fitting lock rod of a length greater than that of the cylinder but shorter than the combined lengths of the latter and the barrel. A friction-held keeper is for insertion into the barrel ahead of the lock rod for the purpose of keeping it in place. An extractor is capable of being connected to the keeper upon insertion into the barrel for purposes of retrieving it preparatory to removing the lock rod. The extractor includes as a part thereof a normally recessed indicator attached to the front end of a probe which projects out the rear end and through an axial opening in the keeper. It engages the front end of the lock rod, so as to extend the indicator and thus provide the user with visual confirmation that the lock rod is fully seated in the cylinder.

A safety device for a firearm which is adapted to be received in the breech of the firearm and which has a retaining member located in but extending through the body thereof. The retaining member can either be in a condition where it is in contact with the breech and acts to prevent outward movement of the device, to a position where it does not obstruct any such outward movement. The safety device can be readily removed from the breech. Preferably, the two positions of the retaining member are controlled by a key operated lock.

A plug is inserted into and withdrawn from the muzzle end of a gun barrel by means of an external grip to store the gun in a safe condition with a dummy cartridge in its firing chamber. A retainer formation within the dummy cartridge is engageable by an elastically deformable lock device fixed to the inner end of the plug. The plug may be respectively locked to an released from the dummy cartridge by opposite insertion and extraction forces of different lock engaging and lock releasing magnitudes to prevent loading and unintended firing of the firearm.

A safety device for locking a rifle, pistol or revolver so that it cannot be accidentally discharged. The device operates by occupying the barrel of the gun and projecting into the breech. It is locked in place by a digital padlock which is used because it is difficult for children and unauthorized person to open, while being easy for an authorized person to open in the dark. Use of the device requires removal or displacement of parts of the weapon, increasing the safety provisions and guarding against accidental firing.

A chamber and bore lock for a firearm includes a rod adapted for receipt within the barrel bore of the firearm. One end of the rod has a fixed plug with an abutting O-ring. A pair of sleeves are received upon the rod with an O-ring therebetween. A threaded cap engages an end of the rod at the muzzle of the firearm. Threaded movement of the cap draws the plug toward the cap, urging the sleeves into compressing and radially deforming engagement with the O-rings which engage inner circumferential surfaces of the barrel bore and firing chamber of the firearm.

There is disclosed a safety device for a firearm in the form of a cartridge insertable within the chamber of a revolver, rifle or the like such that when the particular opening in the firing chamber of the firearm is aligned with the barrel, a plunger will extend from a cartridge-like casing into the barrel and thus block the firing of the firearm. The safety device disclosed to accomplish this purpose is in the nature of a cartridge having a plunger mounted for reciprocal movement therein by a cam and follower-type mechanism such as found in the common ballpoint pen.

SUMMARY OF THE INVENTION

A primary object of the present invention is to provide a tamper proof gun lock that will overcome the shortcomings of the prior art devices.

Another object is to provide a tamper proof gun lock that contains a two piece locking assembly, in which a first piece fits into a firing chamber and a second piece fits into a barrel of a gun which are connected together by a special tool inserted into the barrel to make the gun impossible to fire.

An additional object is to provide a tamper proof gun lock in which the two piece locking assembly is not visible from the exterior of the gun. The gun if desired can be exhibited in a case and since the two piece locking assembly can only be removed by the special tool, it will be harder to remove the two piece locking assembly by an unauthorized person to operate the gun.

A further object is to provide a tamper proof gun lock that is simple and easy to use.

A still further object is to provide a tamper proof gun lock that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a rear perspective view of a revolver, showing the double dummy cartridge ready to be inserted into two chambers of the cylinder.

FIG. 2 is a front exploded perspective view with parts broken away of the instant invention.

FIG. 3 is a cross sectional view taken along line 3—3 in FIG. 2, showing the internal structure of the keeper.

FIG. 3A is a rear perspective view of the revolver with parts broken away, showing the instant invention installed therein.

FIG. 3B is a rear view of the cylinder taken in the direction of arrow 3B in FIG. 3A, showing the dummy cartridge inserted into the two chambers of the cylinder with the rest of the revolver shown in phantom and broken away.

FIG. 3C is a side view taken in the direction of arrow 3C in FIG. 3A with parts broken away, showing the double dummy cartridge inserted into the two chambers of the cylinder.

DETAILED DESCRIPTION OF THE PREFERRED EMBODIMENTS

Figure 4:
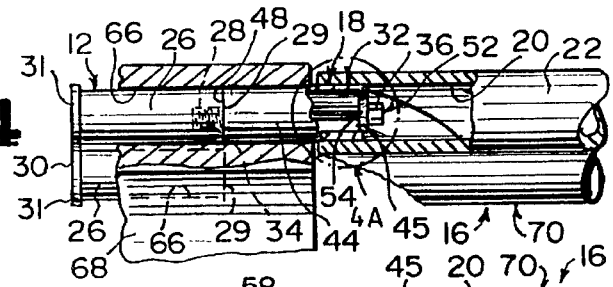
FIG. 4 is a side view taken in the direction of arrow 4 in FIG. 3A with parts broken away, showing the keeper connected to the double dummy cartridge and extending between a portion of the firing chamber of the cylinder and the bore in the barrel of the revolver.
Figure 4A:
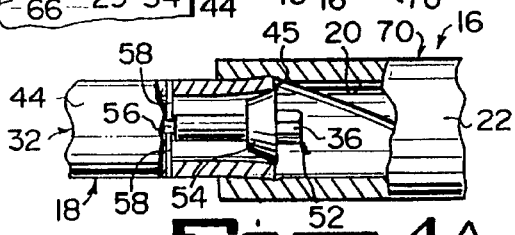
FIG. 4A is an enlargement of a portion of FIG. 4.
Figure 5:
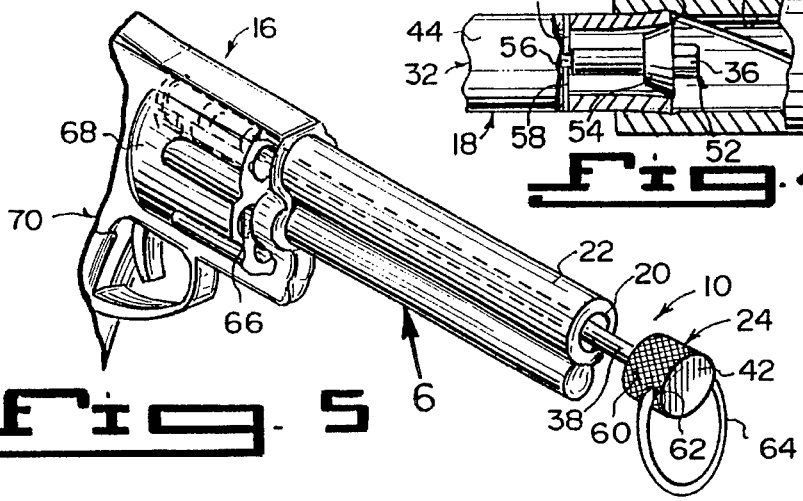
FIG. 5 is a front perspective view with parts broken away taken in the direction of arrow 5 in FIG. 3A.
Figure 6:
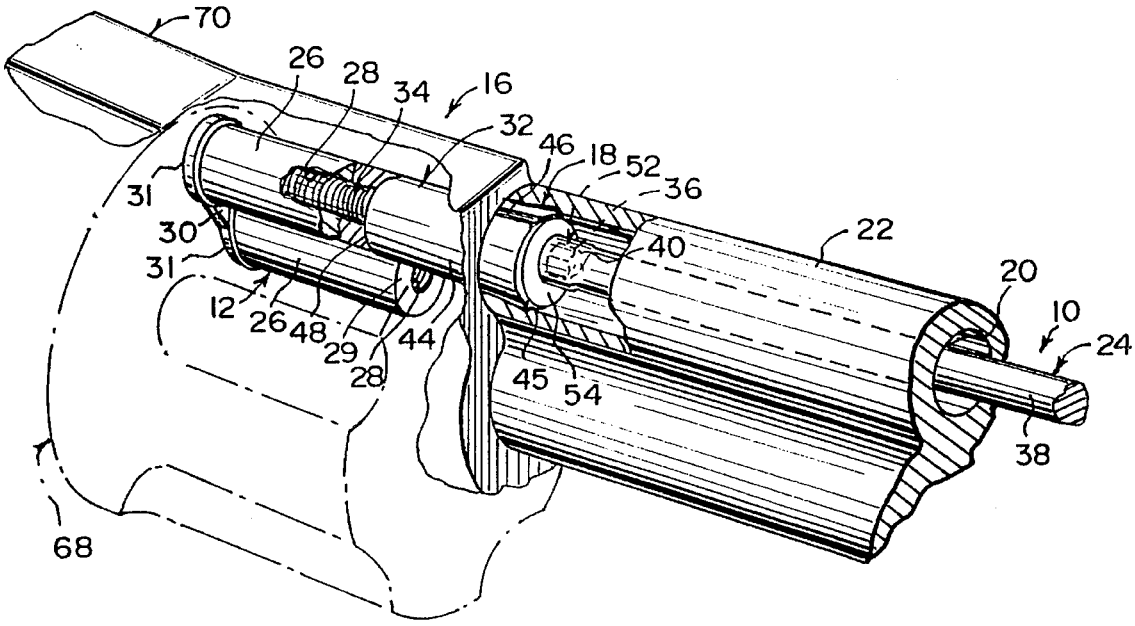
FIG. 6 is an enlarged front perspective view of a portion of FIG. 5 with parts broken away and in phantom as indicated by arrow 6 in FIG. 5.

Turning now descriptively to the drawings, in which similar reference characters denote similar elements throughout the several views, FIGS. 1 through 8 illustrate a tamper proof gun lock 10, which consists of a double dummy cartridge 12 adapted to be received in a firing chamber 14 of a gun 16. A keeper 18 is adapted to be inserted into a bore 20 of a barrel 22 of the gun 16. A tool 24 is insertable into the barrel 22 of the gun, to engage with the keeper 18. In a first instance, the tool 24 can cause the keeper 18 to connect to one portion of the double dummy cartridge 12, making the gun 16 inoperable by preventing the gun 16 from being fired. In a second instance, the tool 24 can cause the keeper 18 to disconnect from the one portion of the double dummy cartridge 12, this allowing the keeper to be removed from the barrel 22 and the double dummy cartridge 12 to be removed from the firing chamber 14 of the gun 16, making the gun 16 operable to be fired.

The double dummy cartridge 12 includes a pair of cylindrical members 26, each having a threaded aperture 28 within a forward end 29. A bridge 30 extends between rearward ends 31 of the cylindrical member 26 to prevent the cylindrical members 26 from rotating within the firing chamber 14 of the gun 16.

The keeper 18 consists of a cylindrical housing 32 having a diameter of a size matching one of the cylindrical members 26 of the double dummy cartridge 12. A threaded shank 34 extends from a rearward end of the cylindrical housing 32 to thread into the threaded aperture 28 of one cylindrical member 26. A specially shaped head 36 extends from a forward end of the cylindrical housing 32 to be operable by the tool 24.

The tool 24 contains an elongated shaft 38 having a specially shaped socket 40 at a first end, to fit over the specially shaped head 36 on the keeper 18, so as to rotate the keeper 18 to thread and unthread the threaded shank 34 with the threaded aperture 28 in one cylindrical member 26 of the double dummy cartridge 12. An operating knob 42 is on a second end of the elongated shank 38, so as to turn the elongated shaft 38.

The keeper 18 further includes the cylindrical housing 32 being a hollow sleeve 44 having an open forward end 45, with a plurality of slots 46 thereabout and a closed rearward end 48 having a central hole 50 therethrough. A screw plug 52 incorporates the threaded shank 34 and the specially shaped head 36 thereon. A tapered collar 54 is on the screw plug 52 about the specially shaped head 36. When the threaded shank 34 is tightened into the threaded aperture 28 of one cylindrical member 26, the tapered collar 54 will cause the open forward end 45 of the hollow sleeve 44 to expand and engage with the bore 20 in the barrel 22 of the gun 16.

The threaded shank 34 of the screw plug 52 has a central countersunk annular groove 56 thereabout. A pair of pins 58 are provided, with each transversely extending from an opposite side of the hollow sleeve 44 to the central countersunk annular groove 56 in the threaded shank 34. The pins 58 retain the screw plug 52 in a rotative position within the hollow sleeve 44.

The tool 24 further includes the operating knob 42 having a knurled circumference 60, so that a person can better grip the operating knob 42, to turn the elongated shank 38. The operating knob 42 also has a transverse opening 62 therethrough. A key ring 64 extends through the transverse opening 62, so that the tool 24 can be carried by and stored on the key ring 64.

As shown in FIGS. 1 through 6, the rearward ends 31 of the cylindrical members 26 of the double dummy cartridge 12 are in a straight alignment with each other. The bridge 30 extends in a straight line between the rearward ends 31. The double dummy cartridge 12 can be inserted within two chambers 66 in a cylinder 68 of a revolver 70 being the gun 16.

Figures 7, 8:
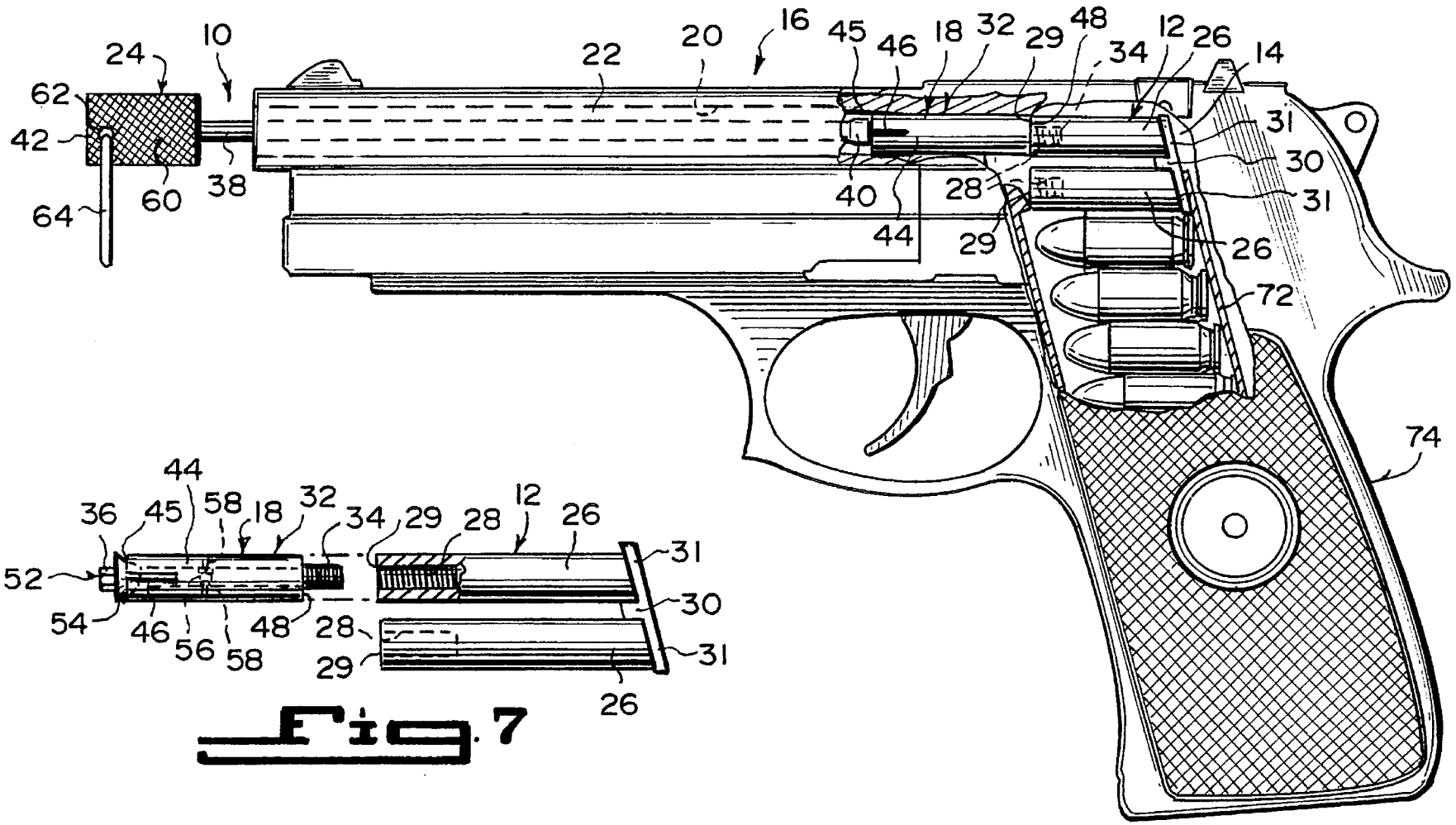
FIG. 7 is a side view with parts broken out showing the instant invention installed in a pistol.
FIG. 8 is an exploded side view with parts in section, showing the keeper ready to be connected to the double dummy cartridge for the magazine used within the pistol shown in FIG. 7.

As shown in FIGS. 7 and 8, the rearward ends 31 of the cylindrical members 26 of the double dummy cartridge 12 are in an angled alignment with each other. The bridge 30 extends in an angled line between the rearward ends 31. The double dummy cartridge 12 can be inserted within a top end of a magazine 72 of a pistol 74 being the gun 16.

LIST OF REFERENCE NUMBERS

10 tamper proof gun lock
12 double dummy cartridge
14 firing chamber
16 gun
18 keeper
20 bore in 22
22 barrel of 16
24 tool
26 cylindrical member of 12
28 threaded aperture in 26
29 forward end of 26
30 bridge of 12
31 rearward end of 26
32 cylindrical housing of 18
34 threaded shank
36 specially shaped head
38 elongated shaft
40 specially shaped socket
42 operating knob
44 hollow sleeve
45 open forward end of 44
46 slot in 44
48 closed rearward end of 44
50 central hole in 48
52 screw plug
54 tapered collar on 52
56 central countersunk annular groove on 34
58 pin
60 knurled circumference on 42
62 transverse opening in 42
64 key ring
66 chamber
68 cylinder
70 revolver for 16
72 magazine
74 pistol for 16

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A tamper proof gun lock which comprises:

a) a plurality of dummy cartridges in an inter-attached arrangement adapted to be received in a plurality of firing chambers of a gun, said plurality of dummy cartridges in an inter-attached arrangement including a pair of cylindrical members, each having a threaded aperture within a forward end, and a bridge extending between rearward ends of said cylindrical members to prevent said cylindrical members from rotating within the plurality of firing chambers of the gun;

b) a keeper adapted to be inserted into a bore of a barrel of the gun, said keeper including a cylindrical housing having a diameter of a size matching one of said cylindrical members of said plurality of dummy cartridges in an inter-attached arrangement, a threaded shank extending from a rearward end of said cylindrical housing to thread into the threaded aperture of one said cylindrical member, and a specially shaped head extending from a forward end of said cylindrical housing to be operable by a tool, said keeper further including said cylindrical housing being a hollow sleeve having an open forward end with a plurality of slots thereabout and a closed rearward end having a central hole therethrough, a screw plug incorporating said threaded shank and said specially shaped head thereon, and a tapered collar on said screw plug about said specially shaped head, so that when said threaded shank is tightened into the threaded aperture of one said cylindrical member, said tapered collar will cause said open forward end of said hollow sleeve to expand and engage with the bore in the barrel of the gun, said threaded shank of said screw plug having a central countersunk annular groove thereabout, and a pair of pins, each transversely extending from an opposite side of said hollow sleeve to said central countersunk annular groove in said threaded shank, to retain said screw plug in a rotative position within said hollow sleeve, said rearward ends of said cylindrical members of said plurality of dummy cartridges in an inter-attached arrangement being in a straight alignment with each other, with said bridge extending in a straight line between said rearward ends, so that said plurality of dummy cartridges in an inter-attached arrangement can be inserted within two chambers in a cylinder of a revolver being the gun; and c) said tool insertable into the barrel of the gun to engage said keeper, so that in a first instance said tool can cause said keeper to connect to one portion of said plurality of dummy cartridges in an inter-attached arrangement, making the gun inoperable by preventing the gun from being fired and in a second instance said tool can cause said keeper to disconnect from the one portion of said plurality of dummy cartridges in an inter-attached arrangement, thus allowing said keeper to be removed from the barrel and said plurality of dummy cartridges in an inter-attached arrangement to be removed from the plurality of firing chambers of the gun, making the gun operable to be fired, said tool including an elongated shaft having a specially shaped socket at a first end to fit over said specially shaped head on said keeper, so as to rotate said keeper to thread and unthread said threaded shank with said threaded aperture in one said cylindrical member of said plurality of dummy cartridges in an inter-attached arrangement, and an operating knob on a second end of said elongated shaft, so as to turn said elongated shaft, said tool further including said operating knob having a knurled circumference, so that a person can better grip said operating knob to turn said elongated shaft, said operating knob having a transverse opening therethrough and a key ring extending through said transverse opening, so that said tool can be carried by and stored on said key ring.

2. A tamper proof gun lock which comprises:

a) a plurality of dummy cartridges in an inter-attached arrangement adapted to be received in a gun, said plurality of dummy cartridges in an inter-attached arrangement including a pair of cylindrical members, each having a threaded aperture within a forward end, and a bridge extending between rearward ends of said cylindrical members to prevent said cylindrical members from rotating within the gun;

b) a keeper adapted to be inserted into a bore of a barrel of the gun, said keeper including a cylindrical housing having a diameter of a size matching one of said cylindrical members of said plurality of dummy cartridges in an inter-attached arrangement, a threaded shank extending from a rearward end of said cylindrical housing to thread into the threaded aperture of one said cylindrical member, and a specially shaped head extending from a forward end of said cylindrical housing to be operable by a tool, said keeper further including said cylindrical housing being a hollow sleeve having an open forward end with a plurality of slots thereabout and a closed rearward end having a central hole therethrough, a screw plug incorporating said threaded shank and said specially shaped head thereon, and a tapered collar on said screw plug about said specially shaped head, so that when said threaded shank is tightened into the threaded aperture of one said cylindrical member, said tapered collar will cause said open forward end of said hollow sleeve to expand and engage with the bore in the barrel of the gun, said threaded shank of said screw plug having a central countersunk annular groove thereabout, and a pair of pins, each transversely extending from an opposite side of said hollow sleeve to said central countersunk annular groove in said threaded shank, to retain said screw plug in a rotative position within said hollow sleeve, said rearward ends of said cylindrical members of said plurality of dummy cartridges in an inter-attached arrangement being in an angled alignment with each other, with said bridge extending in an angled line between said rearward ends, so that said plurality of double dummy cartridges in an inter-attached arrangement can be inserted within a top end of a magazine of a pistol being the gun; and c) said tool insertable into the barrel of the gun to engage said keeper, so that in a first instance said tool can cause said keeper to connect to one portion of said plurality of dummy cartridges in an inter-attached arrangement, making the gun inoperable by preventing the gun from being fired and in a second instance said tool can cause said keeper to disconnect from the one portion of said plurality of dummy cartridges in an inter-attached arrangement, thus allowing said keeper to be removed from the barrel and said plurality of dummy cartridges in an inter-attached arrangement to be removed from the gun, making the gun operable to be fired, said tool including an elongated shaft having a specially shaped socket at a first end to fit over said specially shaped head on said keeper, so as to rotate said keeper to thread and unthread said threaded shank with said threaded aperture in one said cylindrical member of said plurality of dummy cartridges in an inter-attached arrangement, and an operating knob on a second end of said elongated shaft, so as to turn said elongated shaft, said tool further including said operating knob having a knurled circumference, so that a person can better grip said operating knob to turn said elongated shaft, said operating knob having a transverse opening therethrough and a key ring extending through said transverse opening, so that said tool can be carried by and stored on said key ring.

3. A tamper proof gun lock which comprises:

a) a plurality of dummy cartridges adapted to be received in a plurality of firing chambers of a gun, said plurality of dummy cartridges including a pair of cylindrical members, each having a threaded aperture within a forward end, and a bridge extending between rearward ends of said cylindrical members to prevent said cylindrical members from rotating with the plurality of firing chambers of the gun;

b) a keeper adapted to be inserted into a bore of a barrel of the gun; and, c) a tool insertable into the barrel of the gun to engage said keeper, so that in a first instance said tool can cause said keeper to connect to one portion of said plurality of dummy cartridges, making the gun inoperable by preventing the gun from being fired and in a second instance said tool can cause said keeper to disconnect from the one portion of said plurality of dummy cartridges, thus allowing said keeper to be removed from the barrel and said plurality of dummy cartridges to be removed from the plurality of firing chambers of the gun, making the gun operable to be fired.

4. A tamper proof gun lock as recited in claim 3, wherein said keeper includes:

a) a cylindrical housing have a diameter of a size matching one of said cylindrical members of said plurality of dummy cartridges;

b) a threaded shank extending from a rearward end of said cylindrical housing to thread into the threaded aperture of one said cylindrical member; and, c) a specially shaped head extending from a forward end of said cylindrical housing to be operable by said tool.

5. A tamper proof gun lock as recited in claim 4, wherein said tool includes:

a) an elongated shaft having a specially shaped socket at a first end to fit over said specially shaped head on said keeper, so as to rotate said keeper to thread and unthread said threaded shank with said threaded aperture in one said cylindrical member of said plurality of dummy cartridges; and, b) an operating knob on a second end of said elongated shaft, so as to turn said elongated shaft.

6. A tamper proof gun lock as recited in claim 5, wherein said keeper further includes:

a) said cylindrical housing being a hollow sleeve having an open forward end with a plurality of slots thereabout and closed rearward end having a central hole therethrough;

b) a screw plug incorporating said threaded shank and said specially shaped head thereon; and, c) a tapered collar on said screw plug about said specially shaped head, so that when said threaded shank is tightened into the threaded aperture of one said cylindrical member, said tapered collar will cause said open forward end of said hollow sleeve to expand and engage with the bore in the barrel of the gun.

7. A tamper proof gun lock as recited in claim 6, wherein said keeper further includes:

a) said threaded shank of said screw plug having a central countersunk annular groove thereabout; and, b) a pair of pins, each transversely extending from an opposite side of said hollow sleeve to said central countersunk annular groove in said threaded shank, to retain said screw plug in a rotative position within said hollow sleeve.

8. A tamper proof gun lock as recited in claim 4, wherein said keeper further includes:

a) said cylindrical housing being a hollow sleeve having an open forward end with a plurality of slots thereabout and closed rearward end having a central hole therethrough;

b) a screw plug incorporating said threaded shank and said specially shaped head thereon; and, c) a tapered collar on said screw plug about said specially shaped head, so that when said threaded shank is tightened into the threaded aperture of one said cylindrical member, said tapered collar will cause said open forward end of said hollow sleeve to expand and engage with the bore in the barrel of the gun.

9. A tamper proof gun lock as recited in claim 8, wherein said keeper further includes:

a) said threaded shank of said screw plug having a central countersunk annular groove thereabout; and, b) a pair of pins, each transversely extending from an opposite side of said hollow sleeve to said central countersunk annular groove in said threaded shank, to retain said screw plug in a rotative position within said hollow sleeve.

10. A tamper proof gun lock as recited in claim 5, wherein said tool further including said operating knob having a knurled circumference, so that a person can better grip said operating knob to turn said elongated shaft.

11. A tamper proof gun lock as recited in claim 10, wherein said tool further including said operating knob having a transverse opening therethrough and a key ring extending through said traverse opening, so that said tool can be carried by and stored on said key ring.

12. A tamper proof gun lock as recited in claim 5, wherein said tool further including said operating knob having a transverse opening therethrough and a key ring extending through said traverse opening, so that said tool can be carried by and stored on said key ring.

13. A tamper proof gun lock as recited in claim 12, wherein said rearward ends of said cylindrical members of said plurality of dummy cartridges are in an inter-attached arrangement being in a straight alignment with each other, with said bridge extending in a straight line between said rearward ends, so that said plurality of dummy cartridges in said inter-attached arrangement can be inserted within two chambers in a cylinder of a revolver being the gun.

14. A tamper proof gun lock as recited in claim 3, wherein said rearward ends of said cylindrical members of said plurality of dummy cartridges are in an inter-attached arrangement being in a straight alignment with each other, with said bridge extending in a straight line between said rearward ends, so that said plurality of dummy cartridges in said inter-attached arrangement can be inserted within two chambers in a cylinder of a revolver being the gun.

* * * * *

UNITED STATES PATENT AND TRADEMARK OFFICE

CERTIFICATE OF CORRECTION

PATENT NO. : 5,488,794

DATED : Feb. 6, 1996

INVENTOR(S) : Phillip M. Arreguin

It is certified that error appears in the above-identified patent and that said Letters Patent is hereby corrected as shown below:

On the title page,

Item (76), change inventor's name from "Arrequin" to --Arreguin--.

Signed and Sealed this

Third Day of December, 1996

Bruce Lehman

*Attest:*

BRUCE LEHMAN

*Attesting Officer*

*Commissioner of Patents and Trademarks*